US008453353B2

(12) United States Patent
Xie

(10) Patent No.: US 8,453,353 B2
(45) Date of Patent: Jun. 4, 2013

(54) SNAP BLOCK STRUCTURE FOR RACING TYPE BICYCLE SHOES

(76) Inventor: Jin-Long Xie, Taichung (TW)

( * ) Notice: Subject to any disclaimer, the term of this patent is extended or adjusted under 35 U.S.C. 154(b) by 2133 days.

(21) Appl. No.: 11/264,801

(22) Filed: Nov. 1, 2005

(65) Prior Publication Data

US 2007/0094898 A1 May 3, 2007

(51) Int. Cl.
*A43B 5/14* (2006.01)
*B62M 3/08* (2006.01)

(52) U.S. Cl.
USPC ..... 36/131; 74/594.6

(58) Field of Classification Search
USPC ..... 36/131; 74/594.4, 594.6
See application file for complete search history.

(56) References Cited

U.S. PATENT DOCUMENTS

| | | | | |
|---|---|---|---|---|
| 4,827,797 | A * | 5/1989 | Le Faou et al. | 74/594.6 |
| 5,199,192 | A * | 4/1993 | Kilgore et al. | 36/131 |
| 5,363,573 | A * | 11/1994 | Kilgore et al. | 36/131 |
| 5,724,752 | A * | 3/1998 | Lin | 36/131 |
| 7,178,272 | B2 * | 2/2007 | Xie | 36/131 |

FOREIGN PATENT DOCUMENTS

FR 2403757 A * 5/1979

* cited by examiner

*Primary Examiner* — Jila M Mohandesi
*Assistant Examiner* — Sharon M Prange

(57) ABSTRACT

A snap block structure for racing type bicycle shoes includes a hard snapping plate, and a soft anti-skid pad mounted on the snapping plate. Thus, the snap block structure has an anti-skid pad mounted on the snapping plate to provide an anti-skid effect when touching the ground. In addition, the anti-skid pad is combined with the snapping plate rigidly and stably, thereby enhancing the strength of the snap block structure.

11 Claims, 4 Drawing Sheets

SNAP BLOCK STRUCTURE FOR RACING TYPE BICYCLE SHOES

BACKGROUND OF THE INVENTION

1. Field of the Invention

The present invention relates to a snap block structure, and more particularly to a snap block structure for racing type bicycle shoes.

2. Description of the Related Art

In general, the type of a racing type bicycle includes a road-use bicycle and a mountaineering bicycle, so that the two different types of bicycles need to mate with two different types of shoes, snap blocks and bicycle pedals. In practice, the snap block is initially locked on the bottom of the racing type bicycle shoe and then snapped onto the bicycle pedal to secure the racing type bicycle shoe on the bicycle pedal. However, the snap block protrudes from the bottom of the racing type bicycle shoe, so that the user easily slips when the snap block touches the ground, thereby causing danger to the user.

SUMMARY OF THE INVENTION

In accordance with the present invention, there is provided a snap block structure, comprising a hard snapping plate, and a soft anti-skid pad mounted on the snapping plate.

The primary objective of the present invention is to provide a snap block structure having an anti-skid effect.

Another objective of the present invention is to provide a snap block structure that has an anti-skid pad mounted on the snapping plate to provide an anti-skid effect when touching the ground.

A further objective of the present invention is to provide a snap block structure, wherein the anti-skid pad is combined with the snapping plate rigidly and stably, thereby enhancing the strength of the snap block structure.

Further benefits and advantages of the present invention will become apparent after a careful reading of the detailed description with appropriate reference to the accompanying drawings.

DETAILED DESCRIPTION OF THE INVENTION

Figure 2:
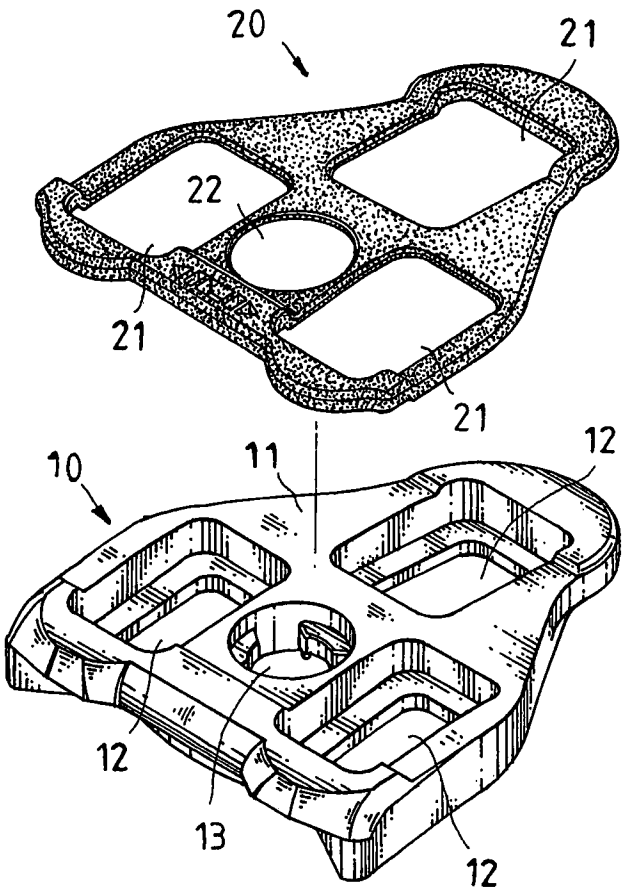
FIG. 2 is an exploded perspective view of the snap block structure as shown in FIG. 1.
Figure 1:
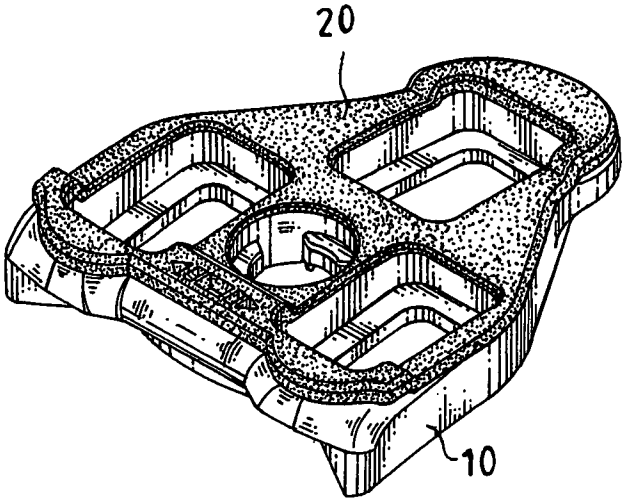
FIG. 1 is a perspective view of a snap block structure in accordance with the preferred embodiment of the present invention.

Referring to the drawings and initially to FIGS. 1 and 2, a snap block structure for racing type bicycle shoes in accordance with the preferred embodiment of the present invention comprises a hard snapping plate 10, and a soft anti-skid pad 20 mounted on the snapping plate 10 to provide an anti-skid effect when touching the ground.

The snapping plate 10 has a face formed with a bonding face 11 having a determined thickness for bonding the anti-skid pad 20 so that the anti-skid pad 20 laminates the bonding face 11 of the snapping plate 10. The snapping plate 10 has a substantially polygonal shape. The snapping plate 10 has a periphery formed with three substantially rectangular locking holes 12 and a substantially circular snapping hole 13 located between the locking holes 12.

The anti-skid pad 20 is made of a soft plastic material, such as PTU, PTR or the like, or a rubber material. The anti-skid pad 20 has a shape matching that of the snapping plate 10. The anti-skid pad 20 has a periphery formed with three substantially rectangular first slots 21 juxtaposed to the locking holes 12 of the snapping plate 10 and a substantially circular second slot 22 located between the first slots 21 and juxtaposed to the snapping hole 13 of the snapping plate 10.

Thus, the snap block is locked onto the bottom of a racing type bicycle shoe and snapped onto a bicycle pedal to secure the racing type bicycle shoe on the bicycle pedal.

Figure 3:
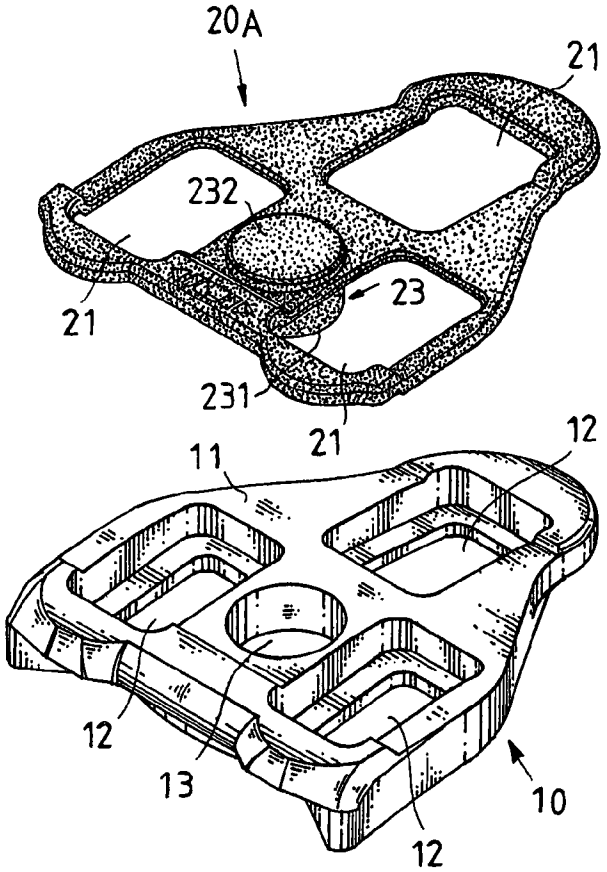
FIG. 3 is an exploded perspective view of a snap block structure in accordance with another preferred embodiment of the present invention.
Figure 4:
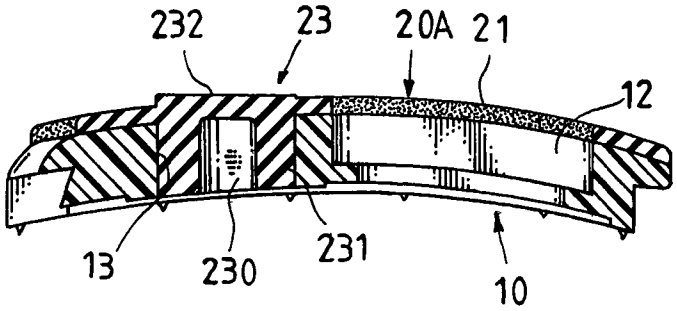
FIG. 4 is a plan cross-sectional assembly view of the snap block structure as shown in FIG. 3.

Referring to FIGS. 3 and 4, the anti-skid pad 20A is integrally formed with a mounting seat 23 mounted in the snapping hole 13 of the snapping plate 10. The mounting seat 23 has a shape matching that of the snapping hole 13 of the snapping plate 10. Preferably, the mounting seat 23 has a substantially circular shape. The mounting seat 23 has a first end formed with an insert 231 protruding from a first side of the anti-skid pad 20A and inserted into the snapping hole 13 of the snapping plate 10 and a second end formed with a resting face 232 protruding from a second side of the anti-skid pad 20A. The insert 231 of the mounting seat 23 has an inside formed with a recess 230.

Figure 5:
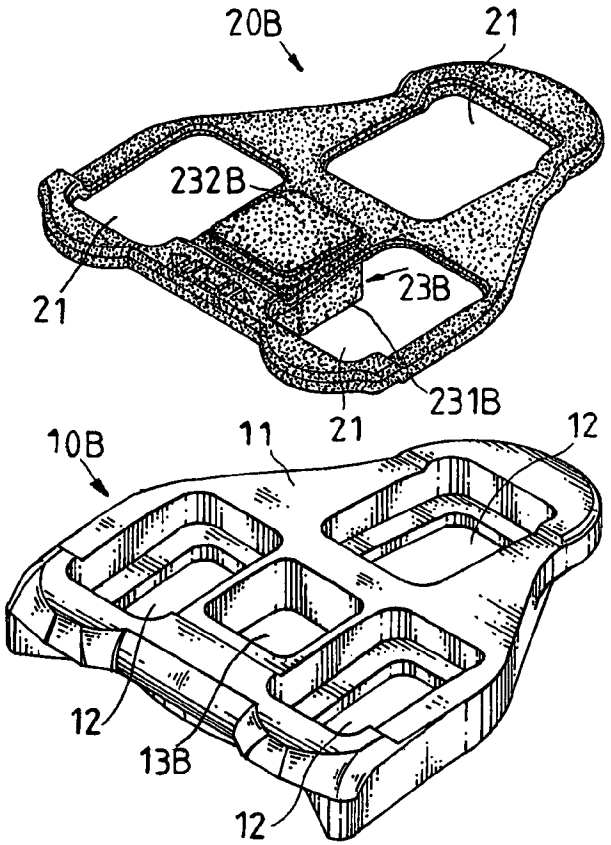
FIG. 5 is an exploded perspective view of a snap block structure in accordance with another preferred embodiment of the present invention.

Referring to FIG. 5, the snapping hole 13B of the snapping plate 10B has a substantially square shape, and the mounting seat 23B of the anti-skid pad 20B has a substantially square shape. In addition, the mounting seat 23B of the anti-skid pad 20B also has an insert 231B and a resting face 232B.

Figure 7:
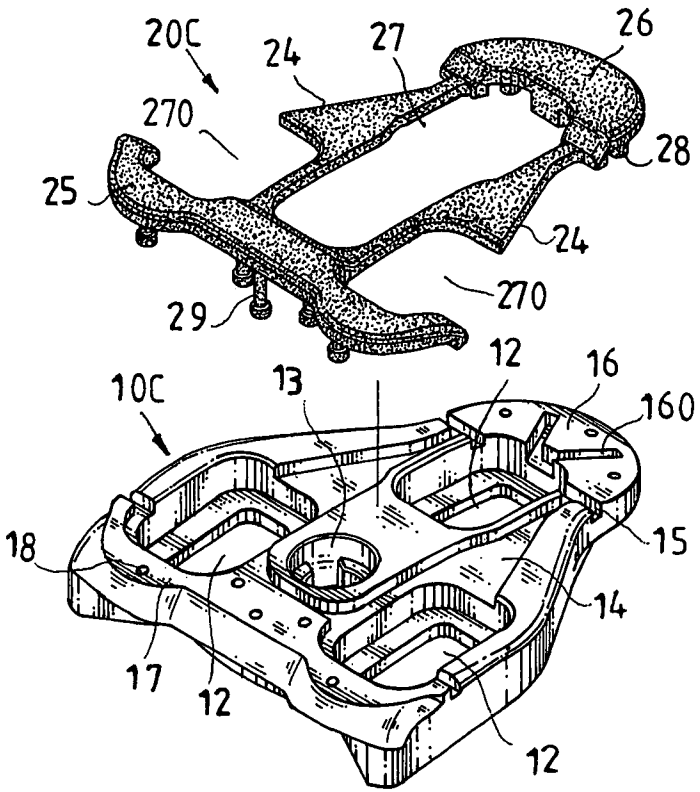
FIG. 7 is an exploded perspective view of the snap block structure as shown in FIG. 6.
Figure 6:
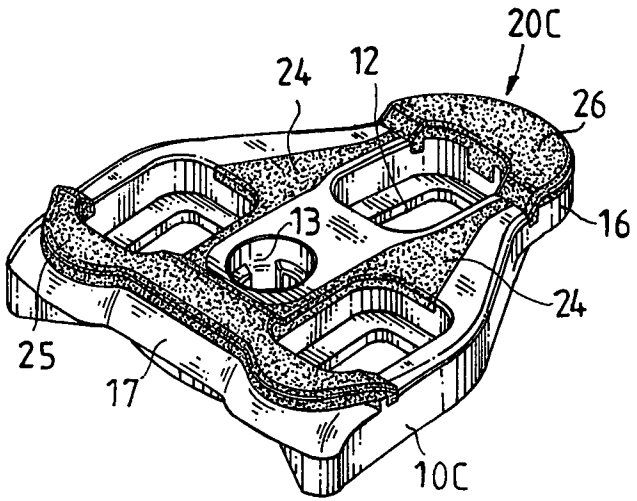
FIG. 6 is a perspective view of a snap block structure in accordance with another preferred embodiment of the present invention.

Referring to FIGS. 6 and 7, the snapping plate 10C has a face having a first end formed with a first lug 16 and a second end formed with a second lug 17. The face of the snapping plate 10C is formed with two opposite depressions 14 located between the first lug 16, the second lug 17, the snapping hole 13 and the locking holes 12. The face of the snapping plate 10C has a plurality of positioning holes 18 formed in the first lug 16 and the second lug 17. The face of the snapping plate 10C has a transverse slit 15 located adjacent to the first lug 16. The first lug 16 of the snapping plate 10C is formed with a substantially V-shaped groove 160.

The anti-skid pad 20C has a first end formed with a first piece 26 mounted on the first lug 16 of the snapping plate 10C and a second end formed with a second piece 25 mounted on the second lug 17 of the snapping plate 10C. The anti-skid pad 20C has two opposite side wings. 24 mounted in the depressions 14 of the snapping plate 10C. The anti-skid pad 20C has a plurality of positioning posts 29 formed on the first piece 26 and the second piece 25 and inserted into the positioning holes 18 of the snapping plate 10C. The anti-skid pad 20C has a transverse protruding rib 28 located adjacent to the first piece 26 and inserted into the slit 15 of the snapping plate 10C. The anti-skid pad 20C has an inside formed with a hollow portion 27 to expose the snapping hole 13 and one the locking holes 12 of the snapping plate 10C. The anti-skid pad 20C has two side openings 270 to expose the other locking holes 12 of the snapping plate 10C.

Accordingly, the snap block structure has an anti-skid pad mounted on the snapping plate to provide an anti-skid effect when touching the ground. In addition, the anti-skid pad is combined with the snapping plate rigidly and stably, thereby enhancing the structural strength of the snap block structure.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A shoe with a snap block structure attached to a sole, comprising:

a hard snapping plate; and a soft anti-skid pad mounted on the snapping plate;

wherein the snapping plate has a periphery formed with three locking holes and a snapping hole located between the locking holes, the anti-skid pad has a hollow portion to expose the snapping hole and one of the locking holes and two side openings juxtaposed to the remaining locking holes;

wherein the snapping plate has a face having a first end formed with a first lug and a second end formed with a second lug, and the anti-skid pad has a first end formed with a first piece mounted on the first lug of the snapping plate and a second end formed with a second piece mounted on the second lug of the snapping plate; and wherein the face of the snapping plate is formed with two opposite depressions located between the first lug, the second lug, the snapping hole and the locking holes, and the anti-skid pad has two opposite side wings mounted in the depressions of the snapping plate.

2. The shoe in accordance with claim 1, wherein the snapping plate has a face formed with a bonding face having a determined thickness for bonding the anti-skid pad.

3. The shoe in accordance with claim 2, wherein the anti-skid pad laminates the bonding face of the snapping plate.

4. The shoe in accordance with claim 1, wherein the snapping plate has a substantially polygonal shape.

5. The shoe in accordance with claim 1, wherein the anti-skid pad is made of a soft plastic material of PTU or PTR or a rubber material.

6. The shoe in accordance with claim 1, wherein the anti-skid pad has a shape matching that of the snapping plate.

7. The shoe in accordance with claim 1, wherein each of the locking holes of the snapping plate is substantially rectangular.

8. The shoe in accordance with claim 1, wherein the snapping hole of the snapping plate is substantially circular.

9. The shoe in accordance with claim 1, wherein the snapping hole of the snapping plate has a substantially square shape.

10. A shoe with a snap block structure attached to a sole, comprising:

a hard snapping plate; and a soft anti-skid pad mounted on the snapping plate;

wherein the snapping plate has a periphery formed with three locking holes and a snapping hole located between the locking holes, the anti-skid pad has a hollow portion to expose the snapping hole and one of the locking holes and two side openings juxtaposed to the remaining locking holes;

wherein the snapping plate has a face having a first end formed with a first lug and a second end formed with a second lug, and the anti-skid pad has a first end formed with a first piece mounted on the first lug of the snapping plate and a second end formed with a second piece mounted on the second lug of the snapping plate;

wherein the face of the snapping plate has a plurality of positioning holes formed in the first lug and the second lug, and the anti-skid pad has a plurality of positioning posts formed on the first piece and the second piece and inserted into the positioning holes of the snapping plate.

11. A shoe with a snap block structure attached to a sole, comprising:

a hard snapping plate; and a soft anti-skid pad mounted on the snapping plate;

wherein the snapping plate has a periphery formed with three locking holes and a snapping hole located between the locking holes, the anti-skid pad has a hollow portion to expose the snapping hole and one of the locking holes and two side openings juxtaposed to the remaining locking holes;

wherein the snapping plate has a face having a first end formed with a first lug and a second end formed with a second lug, and the anti-skid pad has a first end formed with a first piece mounted on the first lug of the snapping plate and a second end formed with a second piece mounted on the second lug of the snapping plate;

wherein the face of the snapping plate has a transverse slit located adjacent to the first lug, and the anti-skid pad has a transverse protruding rib located adjacent to the first piece and inserted into the slit of the snapping plate.

* * * * *